US011534353B2

(12) United States Patent
Kato et al.

(10) Patent No.: US 11,534,353 B2
(45) Date of Patent: Dec. 27, 2022

(54) VEHICLE PROVIDED WITH LIFT UNIT FOR SEAT

(71) Applicant: HONDA MOTOR CO., LTD., Tokyo (JP)

(72) Inventors: Seiji Kato, Saitama (JP); Takeshi Echizenya, Saitama (JP); Wataru Yada, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 89 days.

(21) Appl. No.: 17/200,982

(22) Filed: Mar. 15, 2021

(65) Prior Publication Data

US 2021/0282990 A1 Sep. 16, 2021

(30) Foreign Application Priority Data

Mar. 16, 2020 (JP) ..... JP2020-045088

(51) Int. Cl.
*A61G 5/10* (2006.01)
*A61G 5/12* (2006.01)
*A61G 5/04* (2013.01)

(52) U.S. Cl.
CPC ..... *A61G 5/1059* (2013.01); *A61G 5/04* (2013.01); *A61G 5/1078* (2016.11); *A61G 5/128* (2016.11)

(58) Field of Classification Search
CPC ..... A61G 5/1059; A61G 5/04; A61G 5/1078; A61G 5/128; A61G 5/1089; B62K 17/00; B62K 2201/00; B62J 1/08; B62J 1/12; B62J 2001/085
See application file for complete search history.

(56) References Cited

U.S. PATENT DOCUMENTS 5,435,404 A 7/1995 Garin, III
5,454,579 A 10/1995 Chen
5,690,185 A * 11/1997 Sengel ..... A61G 5/1075 180/907
5,944,131 A * 8/1999 Schaffner ..... A61G 5/043 180/907

(Continued)

FOREIGN PATENT DOCUMENTS

CN 200964142 Y 10/2007
CN 106890053 A * 6/2017

(Continued)

OTHER PUBLICATIONS

First Notification of Office Action for Patent Application CN 202110275706.9 dated Apr. 1, 2022; 11 pp.

*Primary Examiner* — James A Shriver, II
*Assistant Examiner* — Ian Bryce Shelton
(74) *Attorney, Agent, or Firm* — Armstrong Teasdale LLP

(57) ABSTRACT

The vehicle is provided with a seat which is movable between a high position and a low position, and configured to be grounded when the seat is at the low position, and a support leg extending substantially downward from the seat of the vehicle. The support leg is movable between a retracted position positioned close to a vehicle body frame and a deployed position positioned remote from the vehicle body frame, the support leg being configured to be at the retracted position when the seat is at the high position, and to move from the retracted position to the deployed position when the seat moves from the high position to the low position.

4 Claims, 10 Drawing Sheets

(56) References Cited

U.S. PATENT DOCUMENTS

| | | | | |
|---|---|---|---|---|
| 6,129,165 | A * | 10/2000 | Schaffner | A61G 5/125 180/907 |
| 9,061,721 | B2 | 6/2015 | Muto et al. | |
| 10,912,688 | B2 * | 2/2021 | Cooper | A61G 5/1059 |
| 2003/0205420 | A1 * | 11/2003 | Mulhern | A61G 5/06 180/65.1 |
| 2004/0262859 | A1 * | 12/2004 | Turturiello | A61G 5/06 280/5.515 |
| 2005/0206149 | A1 * | 9/2005 | Mulhern | A61G 5/1078 280/755 |
| 2013/0299254 | A1 * | 11/2013 | Mutoh | B62K 11/007 180/21 |
| 2013/0299261 | A1 | 11/2013 | Muto et al. | |
| 2014/0353941 | A1 * | 12/2014 | Muto | B62K 1/00 280/301 |
| 2015/0231002 | A1 * | 8/2015 | Gierse | A61G 5/1075 297/344.17 |
| 2018/0042797 | A1 * | 2/2018 | Richter | A61G 5/041 |
| 2018/0111655 | A1 * | 4/2018 | Inada | B62M 13/00 |
| 2020/0315879 | A1 * | 10/2020 | Takahata | A61G 5/046 |
| 2021/0251826 | A1 * | 8/2021 | Takenaka | B62H 1/12 |

FOREIGN PATENT DOCUMENTS

| | | | | | |
|---|---|---|---|---|---|
| CN | 107349059 | A | * | 11/2017 | |
| CN | 107487406 | A | | 12/2017 | |
| CN | 108001593 | A | | 5/2018 | |
| CN | 108725661 | A | | 11/2018 | |
| FR | 2946246 | A1 | * | 12/2010 | A61G 5/063 |
| JP | 5922489 | A | | 5/2016 | |
| WO | WO-2008124953 | A1 | * | 10/2008 | A61G 5/043 |

* cited by examiner 1
4
19
5
21
22
85
93
18
85
72
86
87
89
88
16
72
91,94
2
14
8
11
3
75
76
79
71
77,83
82
81
74
up
right
rear
down
front
left up
right
rear
front
left
down
5
27
32A
32C
39
24
32B
23
26
43
47
36
46
43
42
32
49
38
50
23
22
21
22A
41
29
31
34
31A
21
28
37
40

5
27
24
up
front
rear
down
18
39
26
27A
38
34
34
28
23
43
47
46
32C
32A
36
23
43
32B
32
52
49
42
29
40
41
51
50
32
21
31A
22
31
22A
37
31
31B
2
2

VEHICLE PROVIDED WITH LIFT UNIT FOR SEAT

TECHNICAL FIELD

The present invention relates to a vehicle provided with a travel unit and a seat supported by the travel unit via a lift unit for changing a height of a seat.

BACKGROUND OF THE INVENTION

JP5922489B2 discloses a vehicle having a travel unit and a seat supported by the drive unit via a lift unit. The travel unit is provided with a drive wheel which is driven under an inverted pendulum control.

When the remaining charge of the battery falls below a certain level or any failure of the vehicle should occur, the vehicle disclosed in JP5922489B2 may become unable to continue the inverted pendulum control. In such a situation, it is necessary for the vehicle occupant to prevent the vehicle from falling over. To effectively deal with such a situation, it is desirable that the vehicle is provided with support legs that prevent the vehicle from falling over when the inverted pendulum control is disabled. To effectively prevent the vehicle from falling over, the support legs are required to extend farther away from the vehicle body. However, if the support legs extend farther away from the vehicle, the vehicle is unable to travel in a limited space.

SUMMARY OF THE INVENTION

In view of such a problem of the prior art, a primary object of the present invention is to provide a vehicle provided with one or more support legs that can support the vehicle in stable manner without excessively increasing the outer profile of the vehicle.

To achieve such an object, the present invention provides a vehicle (1), comprising: a vehicle body frame (2), a travel unit (3) provided on the vehicle body frame and configured to travel on a floor surface; a seat (4) vertically movably supported by the vehicle body frame; a lift unit (5) provided between the seat and the vehicle body frame to move the seat between a high position and a low position; and a support leg (71, 72) extending substantially downward from the seat and configured to be grounded when the seat is at the low position, wherein the support leg is movable between a retracted position positioned close to the vehicle body frame and a deployed position positioned remote from the vehicle body frame, the support leg being configured to be at the retracted position when the seat is at the high position, and to move from the retracted position to the deployed position when the seat moves from the high position to the low position.

Thus, the outer profile of the vehicle can be minimized by placing the support leg at the retracted position when the seat is at the high position which is normally the case when the vehicle is traveling. Thereby, the vehicle is enabled to travel in a relatively limited space. The stability of the vehicle is maximized by placing the support leg at the deployed position when the seat is at the low position which is normally the case when the vehicle is stationary or is parked. Thereby, the vehicle is prevented from falling over in a reliable manner.

Preferably, the support leg includes a first member (75) pivotally connected to the seat at an upper end thereof so as to be movable between the retracted position and the deployed position, a first grounding member (76) provided at a lower end of the first member and configured to ground on the floor surface in a movable manner along the floor surface, and a first biasing member (77) urging the first member toward the retracted position, the first member being configured to move from the retracted position to the deployed position against a biasing force of the first biasing member by a reaction force applied to the first grounding member from the floor surface.

Thereby, the support leg can be deployed from the retracted position to the deployed position upon the grounding of the first grounding member without requiring any power actuator so that the structure for deploying the support leg can be simplified.

Preferably, the support leg further includes a first damper (83) provided between the first member and the seat.

Thereby, the impact on the seat and the vibration of the seat when the support leg is grounded can be reduced.

Preferably, the first member is positioned in a front part of the vehicle, and provided with a footrest (79).

Thereby, the footrest can be automatically moved away from the vehicle or to a use position when the first support leg is grounded.

Preferably, the first grounding member is provided immediately under the footrest.

Thereby, the support surface of the footrest for supporting the feet of the occupant can be positioned as at a low position as possible so that the sitting comfort of the occupant can be maximized.

Preferably, the support leg includes a second member (86) pivotally supported by the seat at an upper end thereof so as to be movable between the retracted position and the deployed position, a second grounding member (87) provided at a lower end of the second member and configured to ground on the floor surface in a movable manner along the floor surface, a third member (88) pivotally supported by an intermediate part of the second member at an upper end thereof and extending downward in a space defined between the vehicle body frame and the second member, a third grounding member (89) provided at a lower end of the third member and configured to ground on the floor surface in a movable manner along the floor surface, and a second biasing member (91) urging a lower part of the third member downward and away from the vehicle body frame.

Thereby, the support leg can be deployed from the retracted position to the deployed position upon the grounding of the second grounding member and the third grounding member without requiring any power actuator so that the structure for deploying the support leg can be simplified.

Preferably, the second grounding member comprises a second roller rotatably supported by the second member, and the third grounding member comprises a third roller having a larger diameter than the second roller and rotatably supported by the third member.

Since the third roller which grounds before the second roller has a larger diameter than the second roller, the support leg can be grounded in a particularly stable manner.

Preferably, the support leg further includes a second damper (94) provided between the third member and the seat.

Thereby, the impact on the seat and the vibration of the seat when the support leg is grounded can be reduced.

Preferably, the travel unit is provided with a drive wheel (8) driven under an inverted pendulum control.

The present invention thus provides a vehicle provided with one or more support legs that can support the vehicle in stable manner without excessively increasing the outer profile of the vehicle.

and

Figure 10:
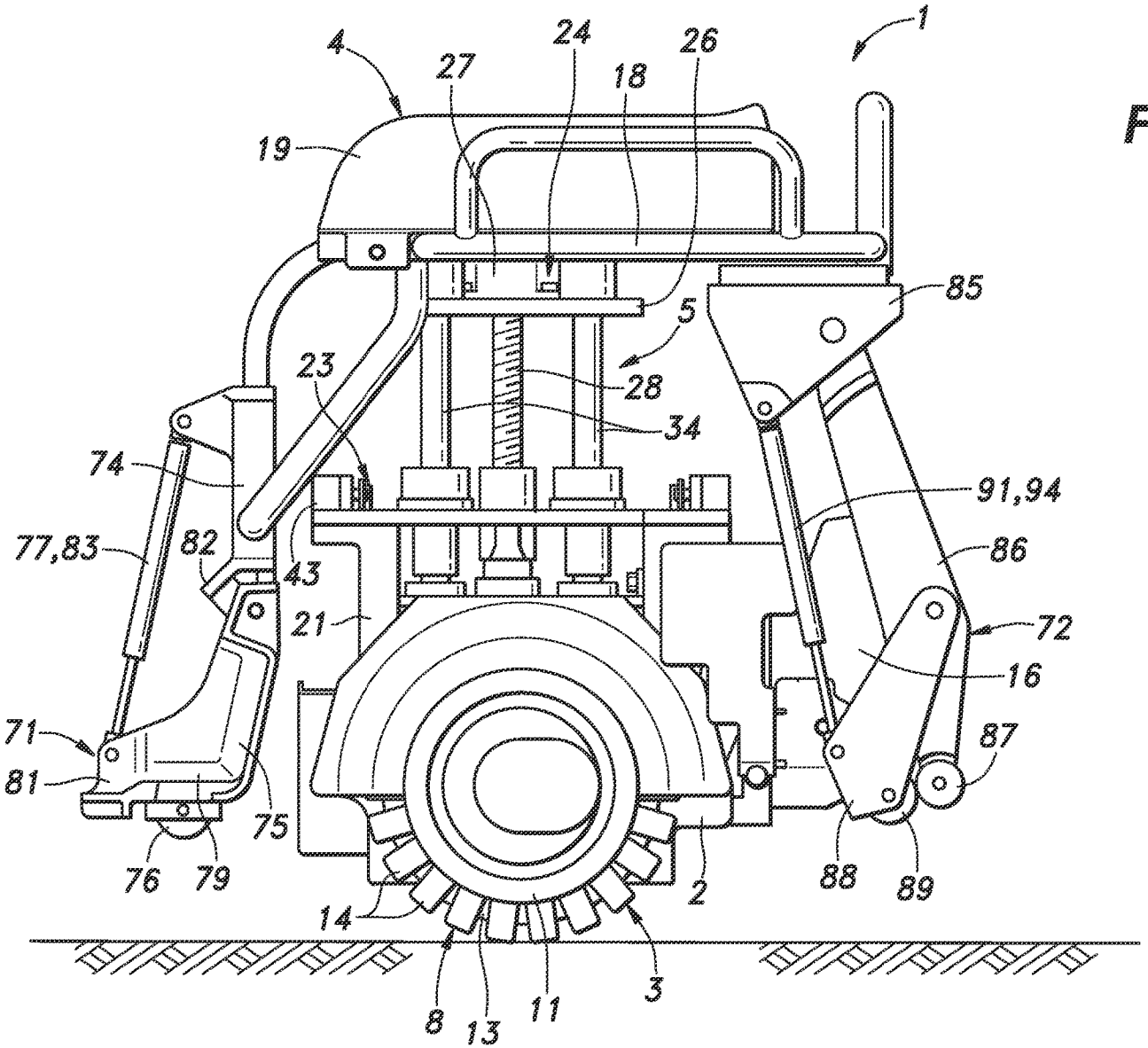

FIG. 10 is a left side view of the vehicle when the seat is at the high position.

DETAILED DESCRIPTION OF THE PREFERRED EMBODIMENT(S)

A preferred embodiment of the present invention as applied to an inverted pendulum vehicle is described in the following with reference to the appended drawings.

Figure 1:
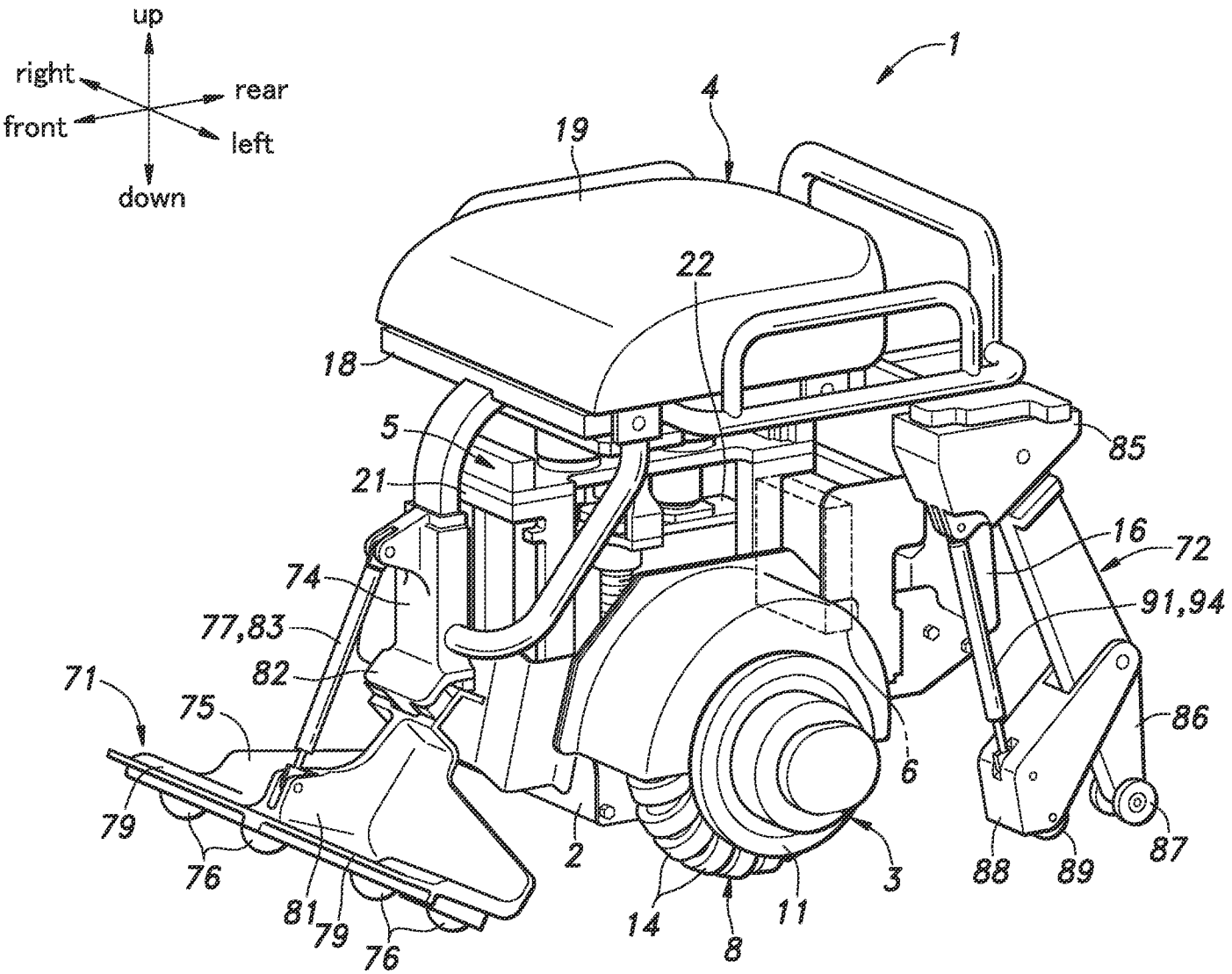
FIG. 1 is a front perspective view of a vehicle according to the present invention when the seat is at a low position.
Figure 2:
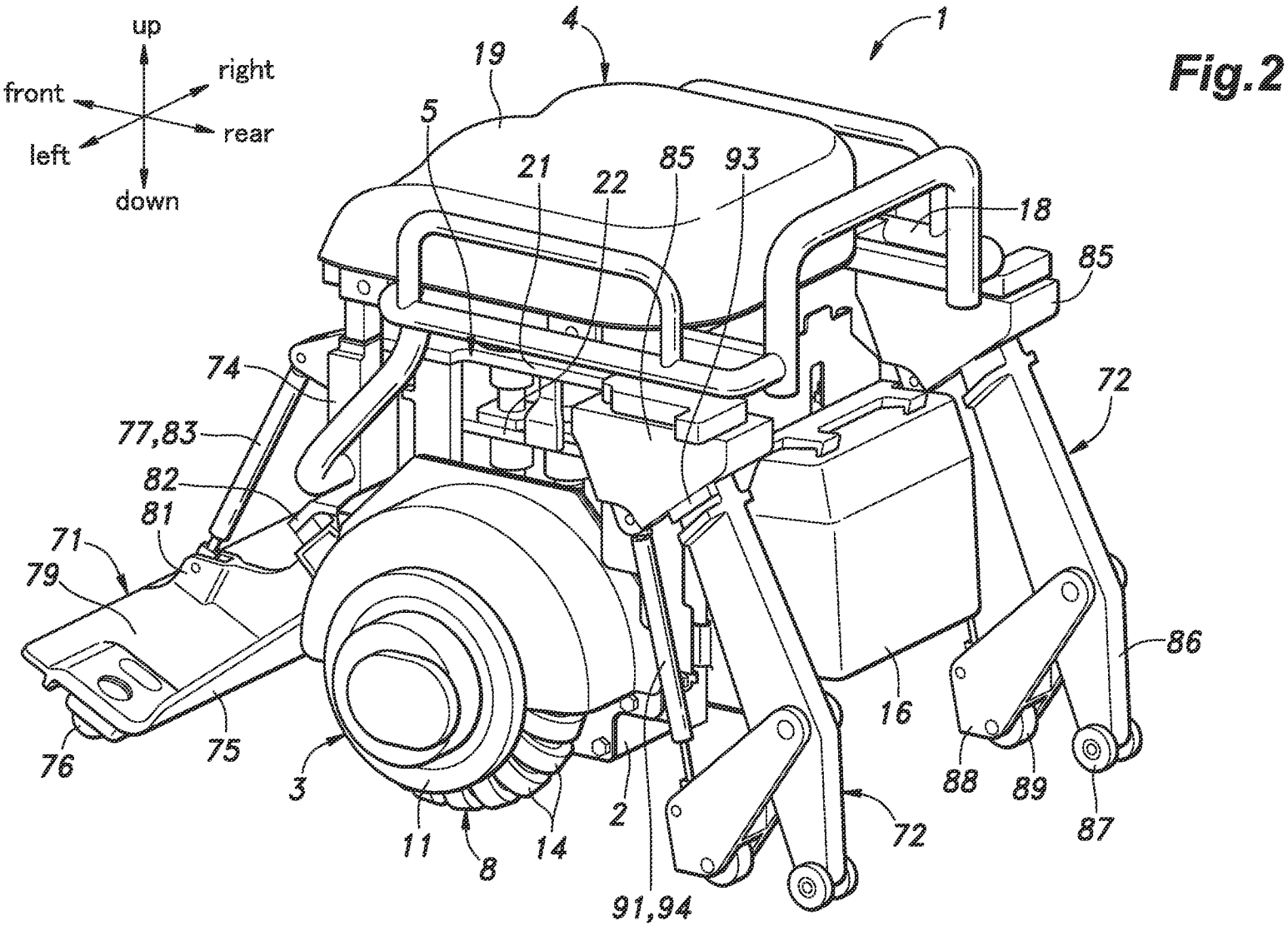
FIG. 2 is a rear perspective view of the vehicle when the seat is at the low position.
Figure 3:
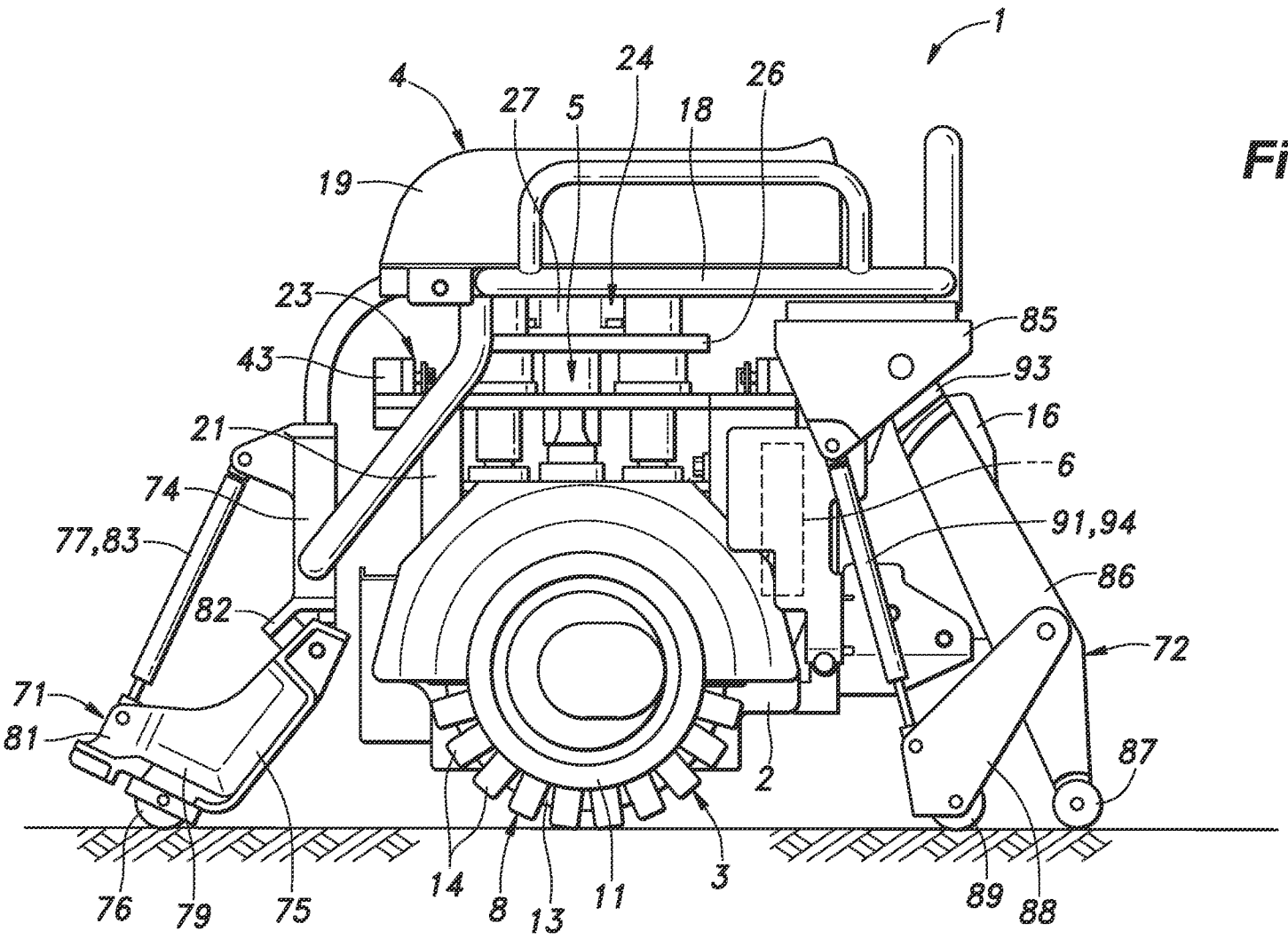
FIG. 3 is a side view of the vehicle when the seat is at the low position.

As shown in FIGS. 1 to 3, the vehicle 1 is provided with a vehicle body frame 2, a travel unit 3 that supports the vehicle body frame 2 and causes the vehicle body frame 2 to travel in any desired direction on the floor, a seat 4 supported by the vehicle body frame 2 and configured to seat a vehicle occupant, a lift unit 5 provided between the vehicle body frame 2 and the seat 4, and a control unit 6 that controls the travel unit 3 and the lift unit 5.

In this embodiment, the travel unit 3 includes a pair of drive wheels 8 placed on either side of the vehicle body frame 2. The travel unit 3 further includes, for each of the drive wheels 8, a pair of drive disks 11 supported by the vehicle body frame 2 so as to be individually and rotatively driven by respective electric motors (not shown in the drawings) around a laterally extending rotational center line, and a plurality of drive rollers (not shown in the drawings) arranged on each drive disk 11 around the rotational center line thereof so as to be freely rotatable each around an oblique rotational center line.

Each drive wheel 8 is provided with a plurality of driven rollers rotatably supported by a ring member 13 like beads on a string, and the drive rollers are pressed against the driven rollers. As the drive disks 11 are turned, the drive wheel 8 is frictionally driven by the cooperation between the drive rollers and the driven rollers.

When the two drive disks 11 are turned in the same direction at the same rotational speed, the drive wheel 8 rotate in the same direction as the drive disks 11. When there is a difference in the direction or speed of rotation between the two drive disks 11, the driven roller 14 of the drive wheel 8 rotates relative to the ring member 13. As a result, the drive wheel 8 produces a lateral traction so that the vehicle receives a lateral propulsive force. Thus, the vehicle 1 is able to travel in any desired direction. See U.S. Pat. No. 9,061,721B2 and other associated prior patent publications for the details of the structure of the travel unit 3.

A battery 16 is mounted on a rear end part of the vehicle body frame 2, and a control unit 6 is mounted inside or on a rear part of the vehicle body frame 2.

The lift unit 5 is configured to raise and lower the seat 4 between a low position and a high position. The seat 4 includes a seat frame 18 supported by the lift unit 5, and a pad 19 placed on top of the seat frame 18. The occupant can be seated on the pad 19. The high position of the seat 4 may be directly above the low position of the seat 4. Alternatively, the high position of the seat 4 may be offset to a lateral side or a fore and aft side of the low position of the seat 4.

Figure 4:
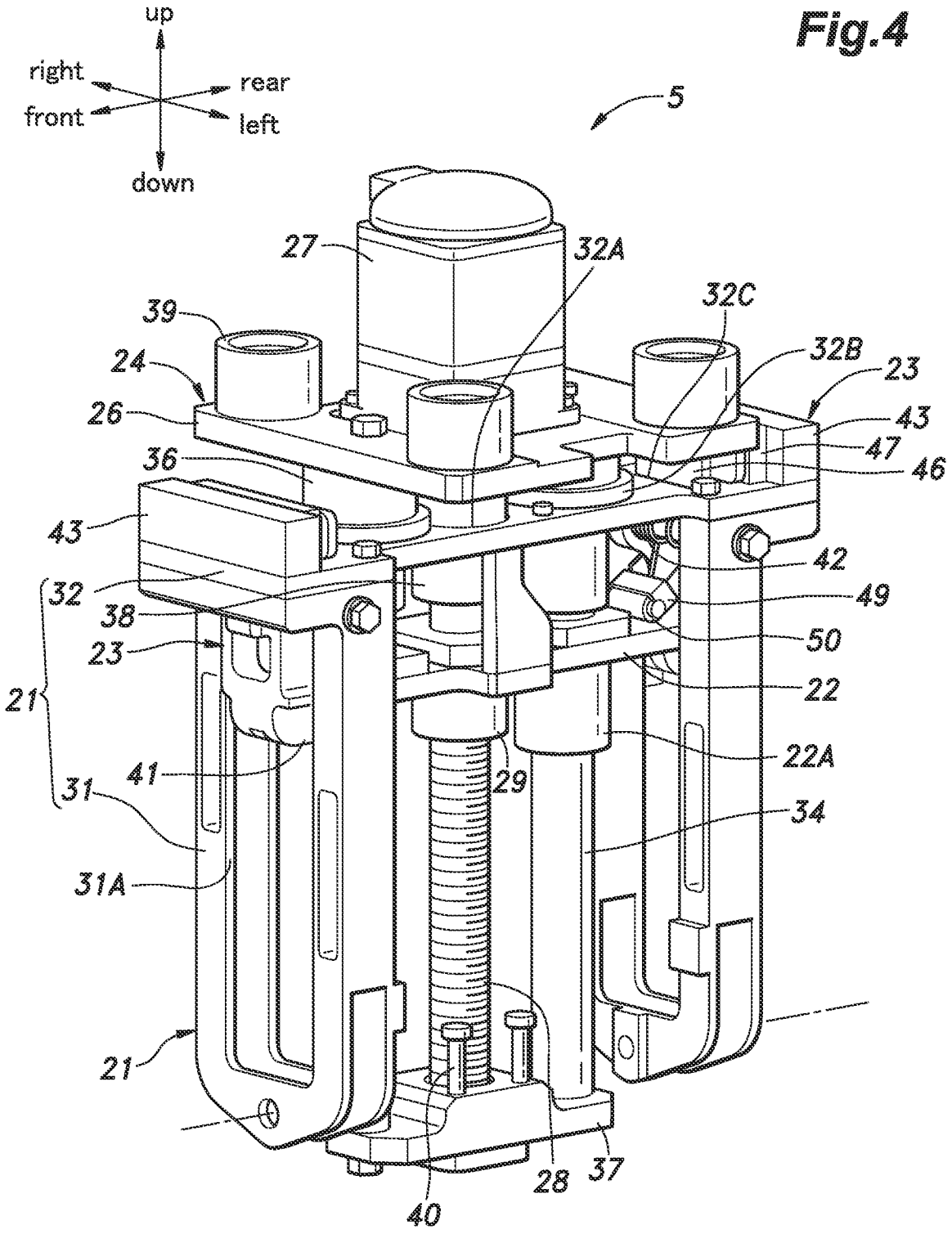
FIG. 4 is a perspective view of a lift unit.
Figure 5:
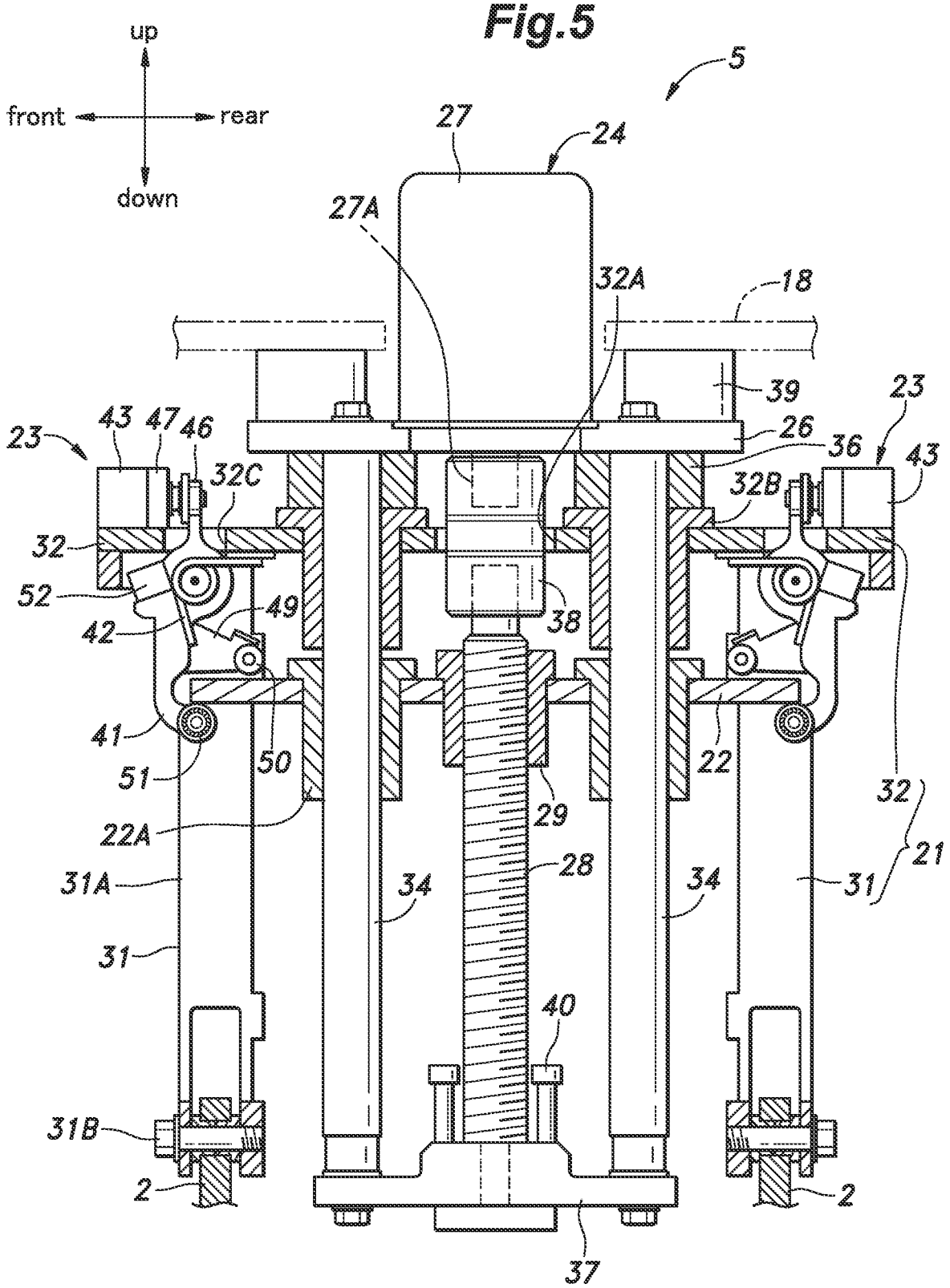
FIG. 5 is a sectional view of the lift unit with a movable member at a reference position and the seat at the low position.

As shown in FIGS. 4 and 5, the lift unit 5 includes a fixed base 21 fixedly attached to the vehicle body frame 2. The fixed base 21 includes a transverse member 32 having a horizontally extending plate-shape, and a pair of identically shaped vertical members 31 extending vertically downward from a front end part and a rear end part of the transverse member 32, respectively. Each vertical member 31 is provided with a shape of letter U, and defines an opening 31A extending through the vertical member 31 in the fore and aft direction.

The lift unit further includes a movable base 22 placed directly under the transverse member 32 of the fixed base 21 in a vertically movable manner (as will be discussed hereinafter), a pair of engagement devices 23 configured to selectively retain the movable base 22 at a predetermined reference position relative to the fixed base 21, and an electric lift mechanism 24 configured to raise and lower the seat 4 relative to the movable base 22. In this embodiment, the engagement devices 23 are configured to selectively engage the front and rear ends of the movable base 22, respectively, to the fixed base 21. The electric lift mechanism 24 is provided with a seat base 26 disposed above the fixed base 21 so as to be vertically movable relative to the fixed base 21 and the movable base 22, an electric motor 27 mounted on the seat base 26 and having an output shaft 27A extending downward therefrom, a screw shaft 28 connected to the output shaft 27A via a shaft coupling 38, and a nut 29 fixedly secured to the movable base 22 and threaded with the screw shaft 28. The seat 4 is fixedly attached to the seat base 26. Thus, the screw shaft 28 extends vertically, and is passed through the movable base 22 via the nut 29

The lower end of each vertical member 31 is provided with a through hole extending in the fore and aft direction, and pivotably connected to an upwardly extending piece of the vehicle body frame 2 via a bolt pin 31B extending in the fore and aft direction. The fixed base 21 including the vertical member 31 and the transverse member 32 is thus retained by a part of the vehicle body frame 2 against the fore and aft movement but is pivotable around the bolt pins 31B. The lateral pivotal movement of the fixed base 21 is limited to a certain angular range by stoppers (although not shown in the drawings). The fixed base 21 is normally maintained in an upright posture under the inverted pendulum control. The vehicle 1 may be propelled in the fore and aft direction by the occupant leaning either in a forward or a rearward direction, and may be propelled in the lateral direction by the occupant leaning sideways in either direction.

The transverse member 32 is provided with a central opening 32A, and a pair of first slide bushes 32B, one in front of the central opening 32A and the other behind the central opening 32A.

A pair of guide rods 34 extend vertically downward from the seat base 26, and are each slidably passed through the corresponding first slide bush 32B so that the seat base 26 is vertically movable relative to the transverse member 32 of the fixed base 21 in a guided manner. Rubber cushions 36 may be provided either on the lower surface of the seat base 26 or the upper surface of the transverse member 32. In this embodiment, the rubber cushions 36 are provided at the upper ends of the first slide bushes 32B through which the guide rods 34 pass. The lower limit position of the seat base 26 relative to the transverse member 32 is defined by the abutting of the lower surface of the seat base 26 against the rubber cushions 36.

Figure 6:
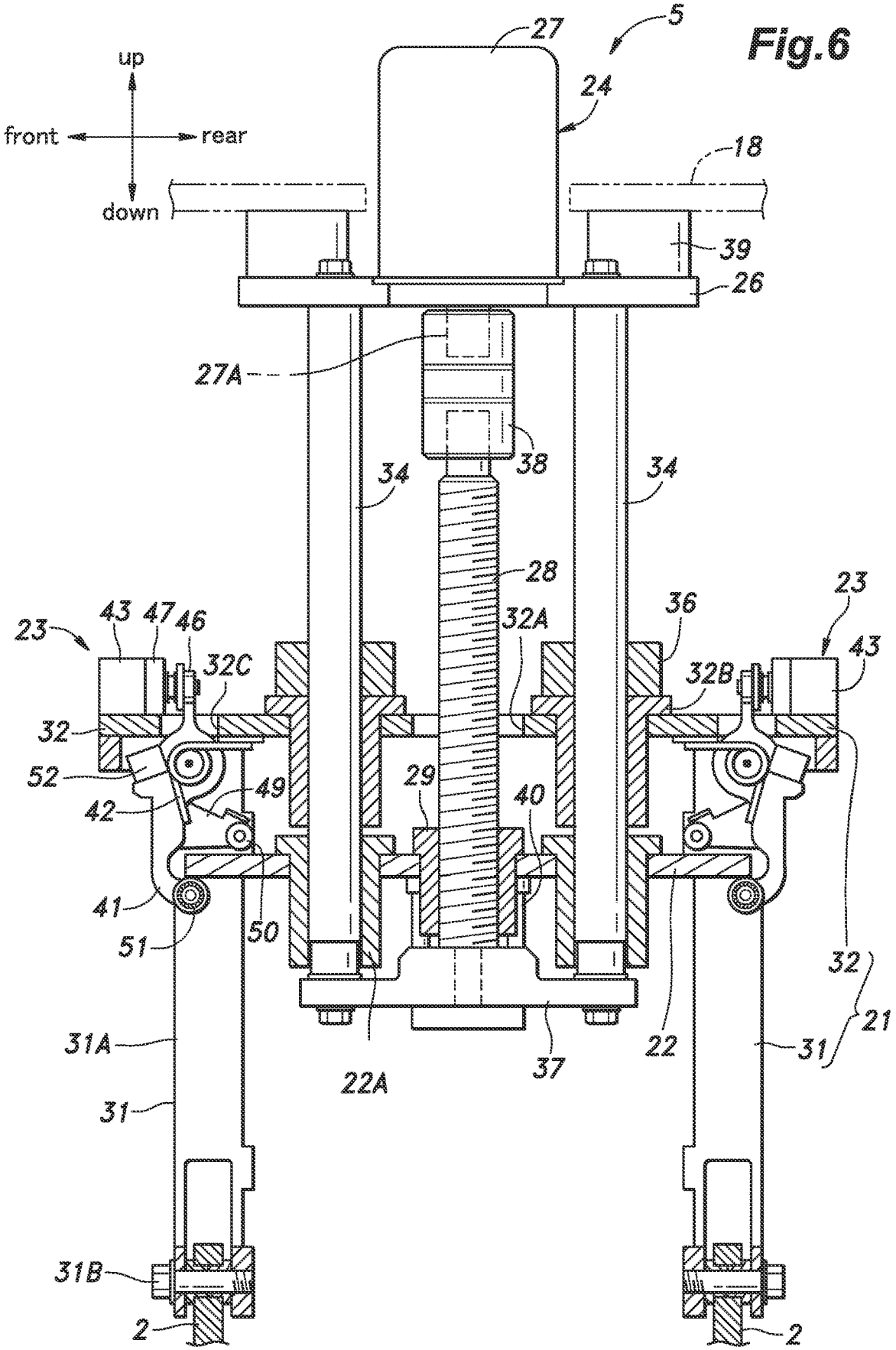
FIG. 6 is a sectional view of the lift unit with the movable member at the reference position and the seat at a high position.

The movable base 22 has a horizontally extending plate-shape, and is provided with a pair of second slide bushes 22A, one in front of the nut 29 and the other behind the nut 29, so as to correspond to the first slide bushes 32B. The guide rods 34 are similarly passed through the second slide bushes 22A, respectively. The lower ends of the guide rods 34 are connected to each other by a lower member 37. As a result, the guide rods 34, the seat base 26 and the lower member 37 form a rectangular frame when viewed from the lateral direction. The lower end of the screw shaft 28 is connected to the lower member 37 in a freely rotatable but axially fast manner. A pair of stoppers 40 protrude upward from the upper surface of the lower member 37, one in front of the screw shaft 28 and the other behind the screw shaft 28. As shown in FIG. 6, the upper limit positions of the lower member 37 and the seat base 26 relative to the movable base 22 are defined by the upper ends of the stoppers 40 abutting against the lower surface of the movable base 22. Thus, the seat base 26 is vertically movable between a high position corresponding to the high position of the seat 4 defined by the abutting of the stoppers 40 against the lower surface of the movable base 22, and a low position corresponding to the low position of the seat 4 defined by the abutting of the seat base 26 against the upper surface of the transverse member 32 of the fixed base 21.

As shown in FIGS. 4 and 5, when the screw shaft 28 is turned by the electric motor 27 in a reverse direction while the movable base 22 is retained at the reference position, the seat base 26 along with the electric motor 27 is raised relative to the fixed base 21 by means of the cooperation between the screw shaft 28 and the nut 29. The output shaft 27A of the electric motor 27, the screw shaft 28, and the guide rods 34 are arranged parallel to each other. The electric motor 27 is incorporated with a magnetic brake which is deactivated during the operation of the electric motor 27, and is activated when no electric current is supplied thereto. Therefore, when electric current is supplied to the electric motor 27, the electric motor 27 is able to provide an output torque, but when no electric power is supplied to the electric motor 27, the output shaft 27A is prevented from rotating even under an external torque.

In this embodiment, the seat base 26 is connected to the seat frame 18 via rubber cushions 39 so as to enhance the seating comfort of the seat 4. An upper part of the electric motor 27 is located inside the seat 4 for space efficiency.

The nut 29 of the movable base 22 preferably consists of a ball screw having a relatively small friction.

Figure 8:
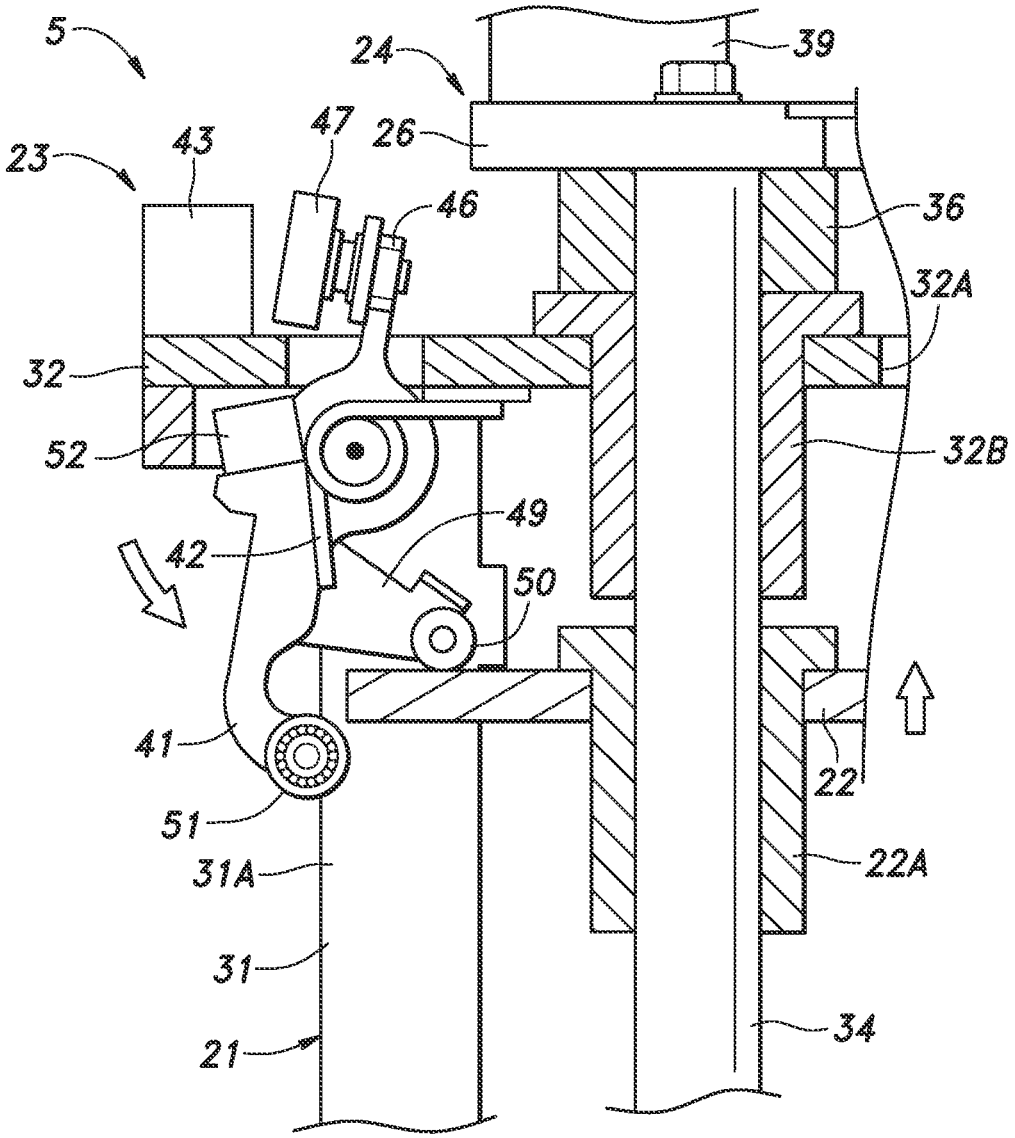
FIG. 8 is a diagram showing the state of an engagement device when the movable member is at the lowered position.
Figure 9:
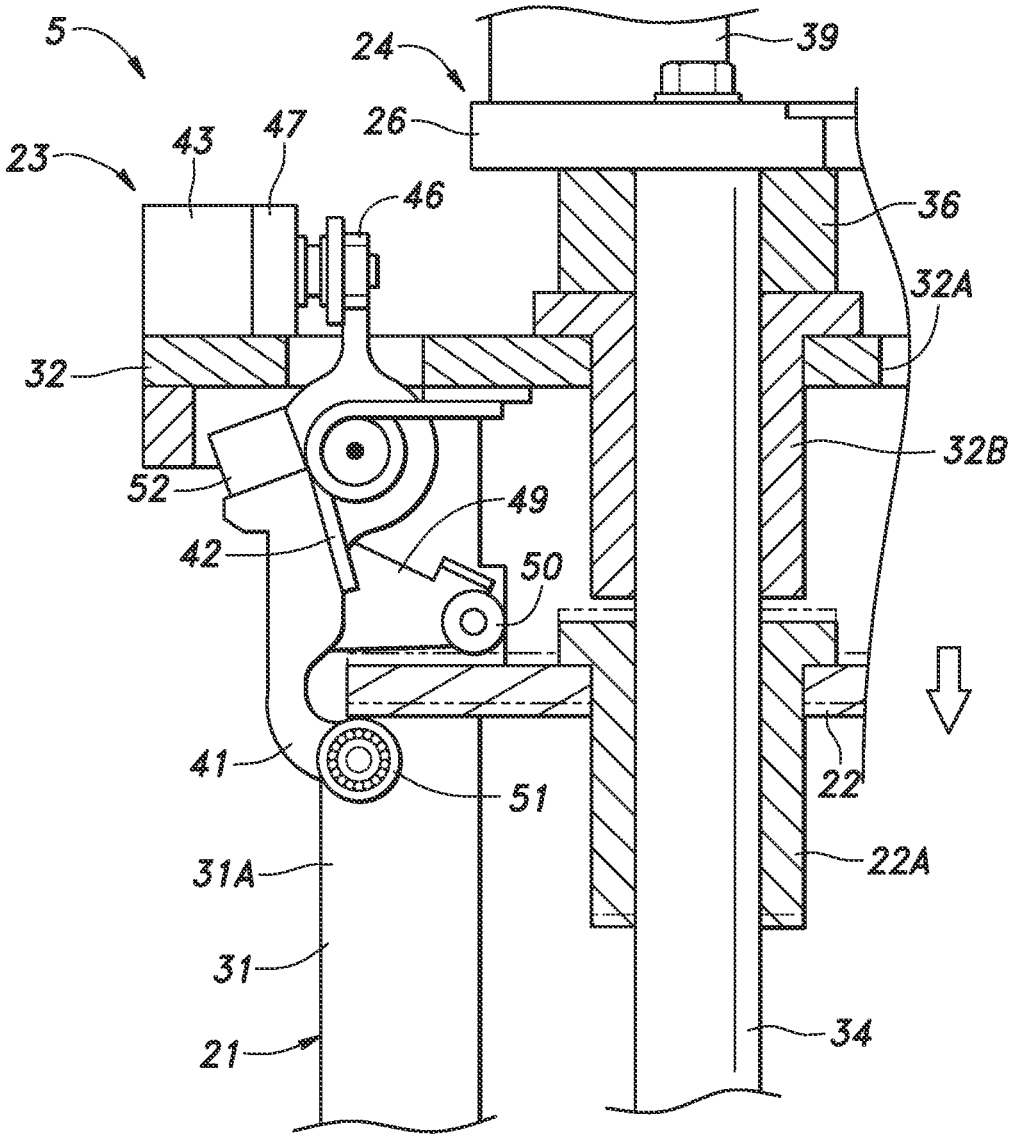
FIG. 9 is a diagram showing the state of the engagement device when the movable member is about to be raised from the lowered position.

As shown in FIGS. 8 and 9, each engagement device 23 includes a hook-shaped engagement piece 41 that can be displaced in a substantially horizontal direction between an engage position and a release position, a biasing member 42 that urges the engagement piece 41 toward the release position, and an electromagnet 43 (retaining device) that retains the engagement piece 41 in the engage position against the biasing force of the biasing member 42. The front and rear engagement devices 23 are configured to be symmetric to each other. Only the front engagement device 23 is described in the following to avoid redundancy.

The base end or the shank part of the hook-shaped engagement piece 41 is rotatably supported by a front end part of the fixed base 21 around a rotational center line extending in the horizontal direction. The engagement piece 41 is curved so as face the convex side thereof in the forward and downward direction.

A protruding piece 46 is provided at the base end of the engagement piece 41 and extends radially outward from the rotational center thereof away from the shank part of the hook-shaped engagement piece 41. The protruding piece 46 extends upwardly through a through hole 32C formed in the transverse member 32, and protrudes above the transverse member 32. An iron piece 47 is attached to the front side of the protruding piece 46, and the electromagnet 43 is attached to the upper surface of the transverse member 32 directly in front the protruding piece 46. Thus, the engagement piece 41 can rotate between a first position (engage position) where the iron piece 47 abuts against the electromagnet 43, and a second position (release position) where the iron piece 47 is spaced away from the electromagnet 43. The electromagnet 43 can detachably retain the iron piece 47 thereto when the engagement piece 41 is at the first position.

The engagement piece 41 is provided with a branch arm 49 branched from the shank part of the hook-shaped engagement piece 41. The branch arm 49 extends rearward from the shank portion of the engagement piece 41 so as to form an extended mouth in cooperation with the tip end of the engagement piece 41. In particular, the branch arm 49 extends substantially in parallel with the tip end of the engagement piece 41 so as to define a space between the branch arm 49 and the tip end of the engagement piece 41. Thus, the branch arm 49 extends to a point upwardly displaced from the tip end of the engagement piece 41 and overlapping with the movable base when the hook is at the release position. In particular, the branch arm 49 extends beyond the straight line connecting the rotational center line of the engagement piece 41 and the tip end of the engagement piece 41 at least when the engagement piece is at the disengage position.

A roller 51 is rotatably provided at the tip end of the engagement piece 41, and another roller 50 is provided at the free end of the branch arm 49. The rotational center lines of these rollers 50, 51 extend in parallel with the rotational center line of the engagement piece 41.

The engagement piece 41 is urged toward the release position by the biasing member 42. In this embodiment, the biasing member 42 consists of a torsion coil spring which is passed around a pivot pin of the engagement piece 41 so as to act between the fixed base 21 and the engagement piece 41. The electromagnet 43 is configured to retain the engagement piece 41 at the engage position by attracting the iron piece 47 of the engagement piece 41.

As shown in FIG. 8, when the engagement piece 41 is at the release position, the engagement piece 41 and the branch arm 49 are inclined downward toward the tip end side. At the release position, the branch arm 49 overlaps with the movable base 22 while the engagement piece 41 does not overlap with the movable base 22 when viewed from above. In other words, when the engagement piece 41 is at the release position, the engagement piece 41 is disengaged from the movable base 22. At this time, the iron piece 47 is positioned away from the electromagnet 43. A stopper 52 preferably made of soft material such as rubber is attached to a front side of the shank portion of the engagement piece 41. At the release position, the stopper 52 contacts the lower surface of the transverse member 32. In other words, the release position of the engagement piece 41 is defined by the abutting of the stopper 52 onto the lower surface of the transverse member 32.

As shown in FIG. 9, when the engagement piece 41 is at the engage position, the tip end of the engagement piece 41 and the branch arm 49 are each positioned substantially horizontally. At the engage position, the branch arm 49 and the engagement piece 41 both overlap with the movable base 22 when viewed from above. In other words, when the engagement piece 41 is at the engage position, the engagement piece 41 can engage the movable base 22 against downward movement. When the engagement piece 41 is at the engage position, the rotational center line of the roller 51 at the tip of the engagement piece 41 may be positioned directly under the rotational center line of the engagement piece 41. When the engagement piece 41 is at the engage position, the iron piece 47 is in contact with and retained by the electromagnet 43.

When electric current is supplied to the electromagnet 43, the electromagnet 43 attracts the iron piece 47 so that the engagement piece 41 is retained at the engage position against the spring force of the biasing member 42. When the electric current ceased to be supplied to the electromagnet 43, the engagement piece 41 moves to the release position under the biasing force of the biasing member 42.

As shown in FIG. 9, the movable base 22 can be retained at the reference position by being engaged by the engagement devices 23. When the movable base 22 is at the reference position and the engagement pieces 41 are in the engaged state, the movable base 22 is retained at the reference position by the tip ends of the engagement pieces 41 via the rollers 51. At this time, the tip ends of the engagement pieces 41 are positioned directly under the movable base 22, and abut against the lower surface of the movable base 22 via the rollers 51. At this time, a gap is created between the upper surface of the movable base 22 and the rollers 50 at the tip ends of the branch arms 49. In this manner, once engaged, the engagement pieces 41 engage the movable base 22 against vertical movement, and retain the movable base 22 at the aforementioned reference position. The contact area between each engagement piece 41 and the movable base 22 is located directly under the rotational center line of the engagement piece 41.

The mode of operation of this vehicle 1 is described in the following. The control unit 6 controls the operation of the electromagnets 43 of the engagement device 23 and the electric motor 27 so that the lift unit 5 may raise and lower the seat 4 as required.

FIG. 5 shows an initial state where the movable base 22 is retained at the reference position, and the seat 4 is at the low position. This is a typical condition when the vehicle 1 is at parking. When the vehicle occupant is seated on the seat 4, the control unit 6 raises the seat 4 to the high position by turning the electric motor 27 in the reverse direction. Thereby, the vehicle occupant can view the surrounding from a high view point. FIG. 6 shows the seat 4 at the high position.

When the vehicle occupant desires to get off from the vehicle 1, the control unit 6 lowers the seat 4 to the low position by turning the electric motor 27 in the normal direction. Thereby, the vehicle occupant can get off from the seat 4 with ease.

When the vehicle 1 is traveling with the seat 4 at the high position as shown in FIG. 5, an emergency situation may occur where the vehicle 1 may not be able to maintain the upright posture or the vehicle occupant is otherwise required to get off from the seat as soon as possible. In such a situation, the seat 4 is required to be lowered as soon as possible. Otherwise, the vehicle occupant will be inconvenienced by being required to get off from the vehicle 1 from a relatively high position.

In such a case, upon detecting an emergency situation, the control unit 6 stops supplying electric power to the electromagnets 43 so that the engagement pieces 41 move from the engage position to the release position under the biasing force of the biasing members 42. As a result, the movable base 22 along with the seat 4 descends by gravity. As this is a free fall, the descent of the seat 4 occurs very quickly without requiring any external power.

Figure 7:
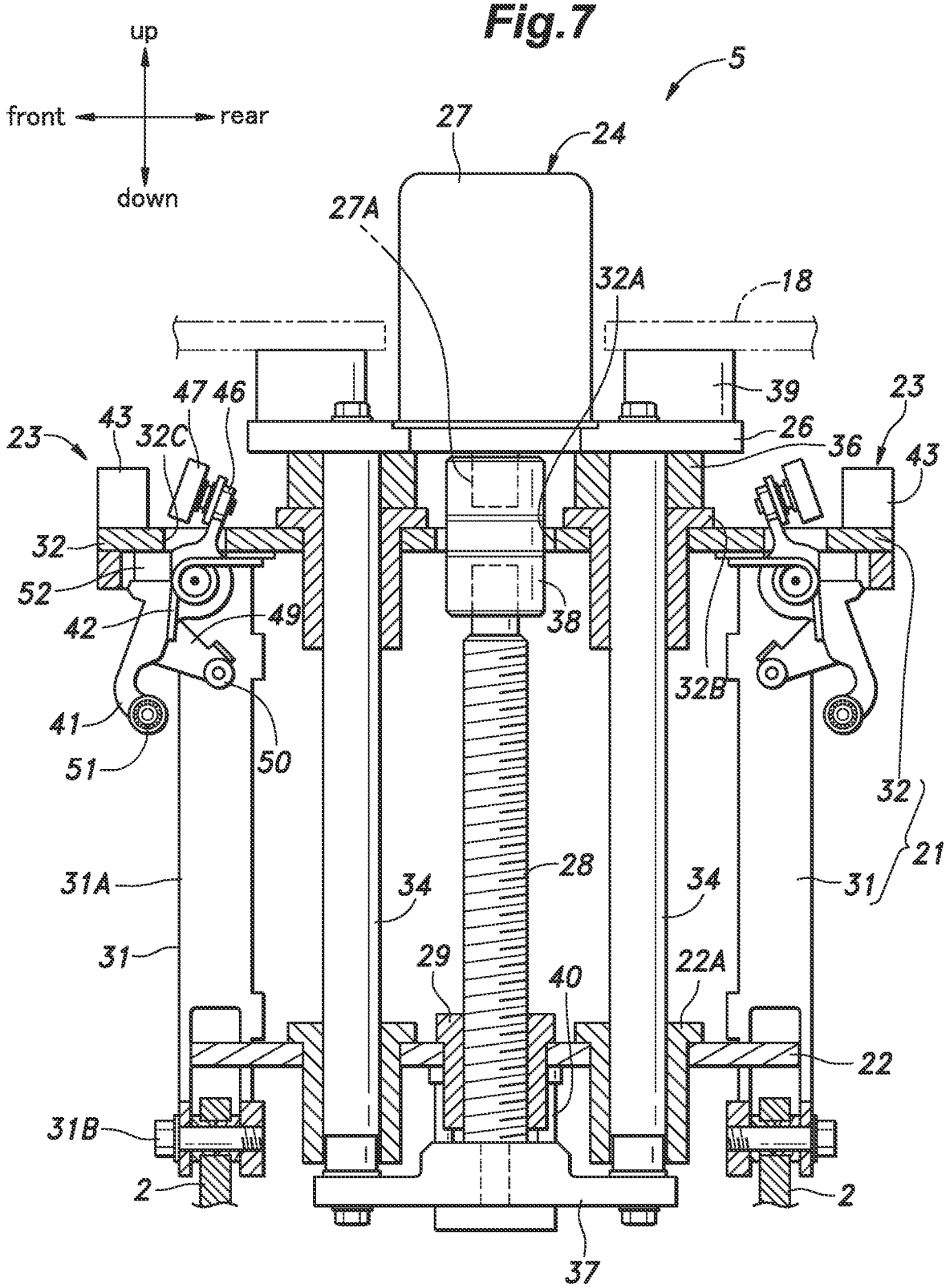
FIG. 7 is a sectional view of the lift unit with the movable member at a lowered position and the seat at the low position.

At this time, the seat base 26 and the lower member 37 (which are connected to each other by the guide rods 34 and the screw shaft 28) also descend together with the movable base 22 (which is connected to the seat base 26 via the screw shaft 28 and the nut 29). The movable base 22 descends until the seat base 26 comes into contact with the transverse member 32 via the rubber cushions 36. This state is shown in FIG. 7. As a result, the seat 4 is placed at the lowermost position in the vertical movement range. The descending speed of the movable base 22 may be adjusted by adjusting the friction between the first slide bushes 32B and the guide rods 34.

The seat 4 can be raised from this lowermost position in the following manner. With the engagement devices 23 in the release position, the electric motor 27 is turned in the normal direction with the result that the movable base 22 is raised owing to the cooperation between the screw shaft 28 and the nut 29.

As the electric motor 27 is turned in the normal direction to raise the movable base 22 toward the reference position, the upper surface of the movable base 22 eventually pushes the branch arms 49 upward against the spring force of the biasing members 42, causing the engagement pieces 41 to be displaced from the release position to the engage position. As a result, the tips of the engagement pieces 41 are positioned under the movable base 22. Once the engagement pieces 41 reach the engage position, the iron pieces 47 contact the respective electromagnets 43, and the rotation of the engagement pieces 41 ceases. As a result, the movement of the movable base 22 is restricted by the branch arms 49, and the load applied to the electric motor 27 increases. Then, the control unit 6 stops the normal rotation of the electric motor 27 based on this increase in load. At the same time, the control unit 6 supplies electric current to the electromagnets 43 to keep the iron pieces 47 attached to the respective electromagnets 43. As a result, the engagement pieces 41 and the iron pieces 47 are held in the engage position. Alternatively, the control unit 6 may start supplying electric current to the electromagnet 43 before the engagement pieces 41 reach the engage position.

After stopping the normal rotation of the electric motor 27, the control unit 6 reverses the rotation of the electric motor 27. As a result, the movable base 22 starts moving downward relative to the seat base 26 and the fixed base 21 as shown in FIG. 9. At this time, the load applied to the electric motor 27 is relatively small during the time the movable base 22 moves downward between the branch arms 49 and the engagement pieces 41. As soon as the lower surface of the movable base 22 comes into contact with the engagement pieces 41, the load on the electric motor 27 starts increasing because the downward movement of the movable base 22 is resisted by the engagement pieces 41. The control unit 6 is thus able to determine that the movable base 22 has reached the reference position by detecting the increase in the load of the electric motor 27.

Once the movable base 22 is brought to the reference position in this manner, the control unit 6 can raise the seat base 26 and the seat 4 relative to the movable base 22 and the fixed base 21 by reversing the rotation of the electric motor 27.

The vehicle 1 has at least one support leg to keep the vehicle 1 in the upright posture even when the inverted pendulum control is turned off. In this embodiment, as shown in FIGS. 1 to 3 and FIG. 10, the vehicle 1 has three support legs 71 and 72 that extend downward from the seat 4 and contact the floor surface when the seat 4 is at the low position. The three support legs 71 and 72 consist of one front support leg 71 positioned centrally in a front end part of the vehicle 1 and a pair of rear support legs 72 positioned on either side of a rear part of the vehicle 1. The support legs 71 and 72 are each pivotably supported at an upper end part thereof so as to be movable between a retracted position at which the support leg is pivoted toward the vehicle 1, and a deployed position at which the support leg is pivoted away from the vehicle 1. In this embodiment, the front support leg 71 is configured to pivot forward when moving from the retracted position to the deployed position, and the rear support legs 72 are configured to pivot rearward when moving from the retracted position to the deployed position. When the seat 4 moves from the high position to the low position, the support legs 71 and 72 move from the retracted position to the deployed position, and are grounded at lower ends thereof.

As shown in FIG. 1, the seat 4 is provided with a front support portion 74 extending forward and then downward centrally from the front end of the seat frame 18, and the front support leg 71 extends downward from a lower end part of the front support portion 74. At least one reinforcing member may be connected between the lower end of the front support portion 74 and the seat frame 18. The front support portion 74 may be formed as a part of the seat frame 18. The front support leg 71 includes a first member 75 connected to the front support portion 74 at the upper end thereof so as to be pivotable around a laterally extending rotational center line, a plurality of first rollers 76 (first grounding member) provided at the lower end of the first member 75, and a first biasing device 77 provided between the first member 75 and the front support portion 74 to urge the first member 75 toward a position corresponding to the retracted position.

The lower end of the first member 75 is provided with a footrest 79 formed as a shelf extending laterally substantially over an entire width of the vehicle and projecting forward for supporting the feet of the occupant. Thus, in this embodiment, the footrest 79 has an L-shaped cross-section when viewed from the lateral direction. The footrest 79 is provided with a trunnion mount 81 projecting forward at its lower end to pivotally support the lower end of the first biasing device 77. The upper end of the first biasing device 77 is pivotally connected to a vertically intermediate part of the front support portion 74.

The first member 75 can be pivoted between a retracted position where the first member 75 is suspended substantially vertically from the front support portion 74 as shown in FIG. 10, and a deployed position where the first member 75 is raised forward by an angle (10 to 45 degrees) from the retracted position. A stopper 82 is provided at a lower end part of the front support portion 74 to define the limit of the rearward pivoting of the first member 75 at the retracted position. The stopper 82 may be provided with a cushioning member such as rubber. By swinging the first member 75 from the retracted position to the deployed position, the lower end of the first member 75 moves away from the vehicle body frame 2 or forward substantially in the horizontal direction.

The first rollers 76 are supported by the footrest 79. In this embodiment, the first rollers 76 consist of four rollers arranged laterally at regular intervals immediately under the footrest. The outer two of the first rollers 76 may have a slightly larger diameter than the inner two of the first rollers 76. The first rollers 76 may consist of simple rollers having a laterally extending rotational center line, caster rollers, or ball rollers. The number of the first rollers 76 may not be four, but less or more than four, and may even be one.

The first biasing device 77 may consist of a linearly extendable cylinder which is normally biased in the extending direction. The first biasing device 77 may consist of an air spring or a spring-loaded device. The first biasing device 77 may also consist of a torsion spring provided at the joint between the front support portion 74 and the first member 75.

As shown in FIG. 10, in absence of any external force, the first member 75 is pushed toward the retracted position by the first biasing device 77. As shown in FIGS. 1 to 3, when the lower end of the first member 75 is pushed upward by the reaction force received from the floor surface via the first rollers 76, the first member 75 swings upward from the retracted position to the deployed position against the biasing force of the first biasing device 77. In particular, the lower end of the first member 75 moves forward along the floor surface and the front support leg 71 is placed in the deployed position. In other words, when the lower end of the first member 75 is pushed upward by the floor surface via the first rollers 76 in response to the lowering of the seat 4, the first member 75 is pushed upward by the floor surface via the first rollers 76 and pivots to the position corresponding to the deployed position.

The front support leg 71 may be provided with a first damper 83 positioned between the first member 75 and the front support portion 74 (or the seat 4) to dampen the movement of the first member 75 relative to the seat 4. The first damper 83 may consist of a fluid damper having a cylinder in which a fluid is enclosed, a piston movable with respect to the cylinder, and a rod coupled to the piston. The first damper 83 may be integrally formed with the first biasing device 77. If the first biasing device 77 consists of an air spring, the air spring may also serve as the first damper 83. In other embodiments, the first damper 83 consists of a rotating damper provided at the joint between the front support portion 74 and the first member 75.

As shown in FIGS. 1 and 2, the rear support legs 72 extend downward from either laterally outer part of the rear of the seat 4. The seat 4 is provided with a pair of rear support pieces 85 projecting downwardly from either lateral end of the rear end of the seat frame 18. The rear support pieces 85 may be formed as a part of the seat frame 18. The rear support legs 72 are provided with an identical configuration, and are supported by the corresponding rear support pieces 85. In the following description, only one of the rear support legs 72 is described to avoid redundancy.

Each rear support leg 72 includes a second member 86 pivotably connected to the seat 4 at the upper end thereof, a second roller 87 (second grounding member) provided at the lower end of the second member 86 and configured to contact the floor surface, a third member 88 pivotably connected to an intermediate part of the second member 86 at the upper end thereof, a third roller 89 (third grounding member) provided at the lower end of the third member 88 and configured to contact the floor surface, and a second biasing device 91 is provided between a lower end part of the third member 88 and the seat 4 to urge the third member 88 in a downward and rearward direction to urge the second member 86 toward a position corresponding to the retracted position. The third member 88 is disposed relative to the second member 86 such that the third member 88 is located ahead of second roller 87 or extends in a space defined between the vehicle body frame 2 and the second member 86.

As shown in FIGS. 3 and 10, the upper end of the second member 86 is connected to the rear support piece 85 so as to be pivotable around a laterally extending rotational center line between a retracted position in which the second member 86 is substantially vertically suspended from the rear support piece 85 and a deployed position in which the second member 86 is tilted rearwardly with respect to the rear support piece 85 around the rotational center line thereof. A stopper 93 is provided on the rear support piece 85 to limit the rearward pivoting movement of the second member 86 to the deployed position. The stopper 93 may be provided with a cushioning member such as rubber. As the second member 86 swings from the retracted position to the deployed position, the lower end of the second member 86 moves away from the vehicle body frame 2 substantially in the horizontal direction, or moves rearward. The second roller 87 is supported at the lower end of the second member 86 so as to be rotatable around a laterally extending rotational center line. The second roller 87 can be any member that is movably grounded onto the floor surface, and may be replaced by a ball or a sled, for example.

The second biasing device 91 may consist of a linearly extendable and retractable cylinder, and is normally urged in the extending direction. The second biasing device 91 may be an air spring or a spring-loaded cylinder. The second biasing device 91 has an upper end pivotably connected to the corresponding rear support piece 85, and a lower end pivotably connected to a front lower end part of the third member 88. The upper end of the second biasing device 91 is positioned a certain distance in front of the upper end of the second member 86. As a result, the rear support piece 85, the second member 86, the third member 88, and the second biasing device 91 form a four-link mechanism that allows the second biasing device 91 to be extended and retracted.

As shown in FIG. 10, when no load is applied to the second roller 87 or the third roller 89 is spaced from the floor surface, the second biasing device 91 is fully extended so that the second member 86 is suspended substantially vertically from the rear support piece 85, and the third member 88 is also suspended substantially vertically from the second member 86. Thus, the four-link mechanism is in a substantially collapsed state. In other words, the angle between the third member 88 and the second biasing device 91 is minimized, and the angle between the second member 86 and the third member 88 is maximized. In this retracted position, the second member 86 is placed at a forward position, i.e., to a position close to the vehicle body frame 2. In this way, the second member 86 is pushed to the retracted position by the second biasing device 91, and the rear support leg 72 is thereby placed in the retracted position.

In the retracted position of the rear support leg 72, the third roller 89 is located below the second roller 87. The diameter of the third roller 89 is larger than the diameter of the second roller 87. The third roller 89 can be any other component that can be grounded in a horizontally movable manner, such as a ball or a sled.

As shown in FIGS. 3 and 10, when the third member 88 is pushed against the floor surface via the third roller 89 as a result of the lowering of the seat 4, the third member 88 pivots forward. At the same time, the second member 86 is pushed by the third member 88 to swing rearward to a position corresponding to the deployed position of the rear support leg 72, causing the second roller 87 to be grounded. More specifically, when the lower end of the third member 88 is pushed upward by the floor surface via the third roller 89, the second biasing device 91 is contracted, and the upper end of the third member 88 is caused to move rearward. This causes the second member 86 to pivot rearward with respect to the rear support piece 85 so that the lower end of the second member 86 moves rearward. As a result, the distance between the lower end of the second member 86 and the lower end of the third member 88 increases, as well as the distance between the lower end of the second member 86 and the vehicle body frame 2. At this time, the lower end of the second member 86 sits on the floor via the second roller 87, and the lower end of the third member 88 sits on the floor via the third roller 89. In this way, the second member 86 moves rearward until the rear support leg 72 is placed at the deployed position.

The rear support leg 72 is provided with a second damper 94 connected between the second member 86 and the seat 4 to dampen the oscillating movement and the impulsive movement of the second member 86 relative to the seat 4. The second damper 94 may be a fluid damper including a cylinder in which a fluid is enclosed, a piston movable with respect to the cylinder, and a rod connected to the piston. The second damper 94 may be formed as an integral part of the second biasing device 91. As described above, if the second biasing device 91 is an air spring, the air spring may also serve as the second damper 94. In the present embodiment, the second damper 94 is formed integrally with the second biasing device 91, and is connected to the rear support piece 85 at one end thereof, and connected to the third member 88 at the other end thereof. Alternatively, the second damper 94 may consist of a rotational damper provided at the junction between the rear support piece 85 and the second member 86, or at the junction between the second member 86 and the third member 88. Similarly, the second biasing device 91 may consist of a torsional spring provided at the junction between the rear support pieces 85 and the second member 86, or at the junction between the second member 86 and the third member 88.

As shown in FIG. 10, when the seat 4 is at the high position, the front support leg 71 is raised from the floor surface, and placed in the retracted position under the biasing force of the first biasing device 77. Likewise, the rear support legs 72 are raised from the floor, and placed in the retracted position under the spring force of the second biasing devices 91.

When the seat 4 is lowered to the low position, the front support leg 71 is pushed by the reaction force received from the floor surface via the first rollers 76, and therefore transitions from the retracted position to the deployed position against the biasing force of the first biasing device 77. The rear support legs 72 are also pushed by the reaction force received from the floor surface via the third rollers 89, and therefore transition from the retracted position to the deployed position against the biasing force of the second biasing devices 91. At this time, the movement of the front support leg 71 is dampened by the first damper 83 and the movement of the rear support legs 72 are dampened by the second dampers 94 so that the downward movement of the seat 4 is dampened.

In the deployed position of the front support leg 71, the first rollers 76, which contact the floor surface, are positioned farther from the vehicle body frame 2 than in the retracted position, thus improving the stability of the vehicle 1. Similarly, in the deployed position of the rear support legs 72, the second rollers 87, which contact the floor surface, are positioned farther from the vehicle body frame 2 than in the retracted position, thereby improving the stability of the vehicle 1.

In the present embodiment, when there is a need to lower the seat 4 as quickly as possible, the control unit 6 stops supplying electric current to the electromagnets 43. As a result, the iron pieces 47 are detached from the electromagnets 43 under the biasing force of the biasing members 42 so that the rollers 51 of the engagement pieces 41 are moved away from the lower surface of the movable base 22. As a result, the movable base 22 is allowed to move downward relative to the fixed base 21 under the gravitational force to place the seat 4 at the low position. Since the downward movement of the movable base 22 along with the seat base 26 occurs as a free fall, the seat 4 can be lowered quickly so as to meet the need in an emergency situation. The downward movement of the movable base 22 ceases when the rubber cushions 39 abut against the lower surface of the seat base 26. The shock at this time is absorbed by the deformation of the rubber cushions 39.

In the present embodiment, since the seat 4 can be lowered without involving the electric lift mechanism 24, the lowering of the seat 4 in an emergency situation can be performed in a quick and reliable manner. Since the displacement direction of the engagement piece 41 and the displacement direction of the movable base 22 are orthogonal to each other, the electromagnet 43 is enabled to maintain the engagement piece 41 in the engage state with a relatively small power. In other words, the power requirement of the electromagnets 43 can be reduced. Furthermore, since the load of the movable base 22 is applied to the tip ends of the engagement pieces 41 in the radial direction with respect to the rotational center line of the engagement pieces 41, the force to be generated by the electromagnets 43 to retain the iron pieces 47 in the engaged state can be reduced. As a result, the power consumption of the electromagnets 43 can be minimized.

When the seat 4 is desired to be restored to the high position, the electric motor 27 is turned in the normal direction, and the supply of electric current to the electromagnets 43 is resumed. Owing to the threading of the screw shaft 28 with the nut 29, the movable base 22 is raised upward until the movable base 22 comes to abut against the rollers 50 of the branch arms 49. As the movable base 22 is raised further, the engagement pieces 41 are pivoted in such a manner that the iron pieces 47 are brought into contact with the corresponding electromagnets 43. As a result, the rollers 51 of the engagement pieces 41 are placed in an overlapping relationship with the movable base 22. The engagement pieces 41 are thus brought back to the engage position whereby the movable base 22 is firmly joined to the fixed base 21. During this process, the seat 4 remains at the low position.

If the control unit 6 activates the electric motor 27 in the reverse direction at this time, since the movable base 22 is firmly joined to the fixed base 21, the seat base 26 along with the seat 4 is raised relative to the vehicle body frame 2 until the stoppers 40 provided on the lower member 37 abut against the lower surface of the movable base 22. As a result, the seat 4 assumes the high position.

When the seat 4 is desired to be lowered from the high position slowly or in a gradual manner, the electric motor 27 is turned in the normal direction so that the seat base 26 along with the seat 4 may be lowered by means of the cooperation between the screw shaft 28 and the nut 29 until the lower surface of the seat base 26 abut against the rubber cushions 36. Thus, the lift unit 5 transitions from the state shown in FIG. 6 to the state shown in FIG. 5.

In the present embodiment, when the seat 4 is at the high position, the support legs 71 and 72 are each in the retracted position so that the support legs are prevented from protruding from the outer profile of the vehicle 1, and the vehicle 1 is enabled to travel in a limited space. When the seat 4 is at the low position, the support legs 71 and 72 are each at the deployed position so that the stability of the vehicle 1 on the floor surface can be maximized. Since the support legs 71 and 72 change from the retracted position to the deployed position as a result of the contact with the floor surface, no driving device is required for this change. Therefore, the structure of support leg 71 and 72 can be simplified and downsized.

Since the support legs 71 and 72 are equipped with the dampers 83 and 94, the impact on the occupant seated in the seat 4 at the time when the support legs 71 and 72 are displaced from the retracted position to the deployed position by the contact with the floor surface can be reduced.

The footrest 79 is provided on the first member 75 so as to be displaceable between the retracted position and the deployed position together with the first member 75. Therefore, when the front support leg 71 is in the deployed position, the footrest 79 is suitably moved forward for the convenience of the occupant. In addition, since the footrest 79 is grounded via the first roller 76 in the deployed position of the first support leg 71, the sole of the occupant's foot is positioned close to the floor surface so that the occupant can stabilize his or her posture in a comfortable manner.

The rear support legs 72 are each provided with a second member 86 and a third member 88 which are bifurcated from each other, and are grounded at the second roller 87 and the third roller 89, respectively, provided at the lower ends thereof. Therefore, the rear support legs 72 can support the vehicle 1 on the floor surface in a stable manner. In addition, since the third rollers 89 contact the floor surface before the second rollers 87 do the same, and the diameter of the third rollers 89 is larger than the diameter of the second rollers 87, the rear support legs 72 can contact the floor surface with a good stability.

The present invention has been described in terms of a specific embodiment, but is not limited by such an embodiment, and can be modified in various ways without departing from the scope of the present invention.

The number of the support legs 71 and 72 is not limited to three, but other arrangements are possible without departing from the scope of the present invention. For instance, there may be only one leg, either in in the front or the rear, two support legs, one in front of the vehicle and the other in the rear of the vehicle, and so on.

The first rollers 76, the second rollers 87, and the third rollers 89 may be replaced by other components that can be grounded on the floor surface and are movable along the floor surface. The first rollers 76, the second rollers 87, and the third rollers 89 may also be balls rotatably provided in the footrest 79, the second member 86, and the third member 88, or curved surfaces fixed to these members so as to function as sleds.

The invention claimed is:

1. A vehicle, comprising:

a vehicle body frame;

a travel unit provided on the vehicle body frame and configured to travel on a floor surface;

a seat vertically movably supported by the vehicle body frame;

a lift unit provided between the seat and the vehicle body frame to move the seat between a high position and a low position; and a support leg extending substantially downward from the seat and configured to be grounded when the seat is at the low position, wherein the support leg is movable between a retracted position positioned close to the vehicle body frame and a deployed position positioned remote from the vehicle body frame, the support leg being configured to be at the retracted position when the seat is at the high position, and to move from the retracted position to the deployed position when the seat moves from the high position to the low position, wherein the support leg includes a second member pivotally supported by the seat at an upper end thereof so as to be movable between the retracted position and the deployed position, a second grounding member provided at a lower end of the second member and configured to ground on the floor surface in a movable manner along the floor surface, a third member pivotally supported by an intermediate part of the second member at an upper end thereof and extending downward in a space defined between the vehicle body frame and the second member, a third grounding member provided at a lower end of the third member and configured to ground on the floor surface in a movable manner along the floor surface, and a second biasing member urging a lower part of the third member downward and away from the vehicle body frame.

2. The vehicle according to claim 1, wherein the second grounding member comprises a second roller rotatably supported by the second member, and the third grounding member comprises a third roller having a larger diameter than the second roller and rotatably supported by the third member.

3. The vehicle according to claim 2, wherein the support leg further includes a second damper provided between the third member and the seat.

4. The vehicle according to claim 1, wherein the travel unit is provided with a drive wheel driven under an inverted pendulum control.

* * * * *